US005925236A

United States Patent [19]

Fersing et al.

[11] Patent Number: 5,925,236

[45] Date of Patent: Jul. 20, 1999

[54] PROCESSES FOR VISBREAKING HEAVY HYDROCARBON FEEDSTOCKS

[75] Inventors: Marc Fersing, St. Andresse; Luc Gouzien, Le Havre; Elisabeth Mouchot, Etoutteville; Geraud Bourley, Martiques, all of France

[73] Assignee: Total Rafinage Distribution S.A., Puteaux, France

[21] Appl. No.: 08/760,678

[22] Filed: Dec. 4, 1996

[30] Foreign Application Priority Data

Dec. 4, 1995 [FR] France ..... 95 14314

[51] Int. Cl.[6] ..... C10G 9/14

[52] U.S. Cl. ..... 208/131; 208/106; 208/67; 208/75; 208/72; 208/68

[58] Field of Search ..... 208/131, 106, 208/67, 75, 72, 68

[56] References Cited

U.S. PATENT DOCUMENTS

| | | | |
|---|---|---|---|
| 1,899,889 | 2/1933 | Bayne | 208/131 |
| 2,161,247 | 6/1939 | Dearborn | 208/131 |
| 2,312,719 | 3/1943 | Kuhl | 208/7 |
| 4,247,387 | 1/1981 | Akbar | 208/106 |
| 4,551,233 | 11/1985 | Blauwhoff et al. | 208/106 |
| 4,695,367 | 9/1987 | Ezernack et al. | 208/106 |
| 4,784,744 | 11/1988 | Rudnick | 208/48 |
| 4,836,909 | 6/1989 | Matsuo et al. | 208/72 |

FOREIGN PATENT DOCUMENTS

| | | | |
|---|---|---|---|
| A-0 007 656 | 2/1980 | European Pat. Off. | C10G 9/04 |
| A-0 166 604 | 1/1986 | European Pat. Off. | C10G 51/02 |
| A-0 204 410 | 12/1986 | European Pat. Off. | C10B 55/00 |
| A-2 528 444 | 12/1983 | France | C10G 9/36 |
| A-2 133 034 | 7/1984 | United Kingdom | C10G 9/16 |

*Primary Examiner*—Walter D. Griffin
*Assistant Examiner*—Nadine Preisch
*Attorney, Agent, or Firm*—Frommer Lawrence & Haug LLP; A. Thomas S. Safford

[57] ABSTRACT

In a process and apparatus for visbreaking a heavy hydrocarbon feedstock in the liquid state, whereby the feedstock is brought to an appropriate temperature to cause cracking of at least part of the hydrocarbons present, and is then introduced into the bottom of a soaker (3) wherein it travels from bottom to top, and is then discharged from the top of said soaker (3) and directed to a fractionation unit, the improvement wherein a preferably inert gas is injected into the hydrocarbon feedstock inside the soaker (3), in the vicinity of the soaker side walls, at least at the bottom of the soaker (3) and the gas is injected upward along the side walls of the soaker (3) and flows from bottom to top along said walls co-currently with the hydrocarbon feedstock.

11 Claims, 1 Drawing Sheet

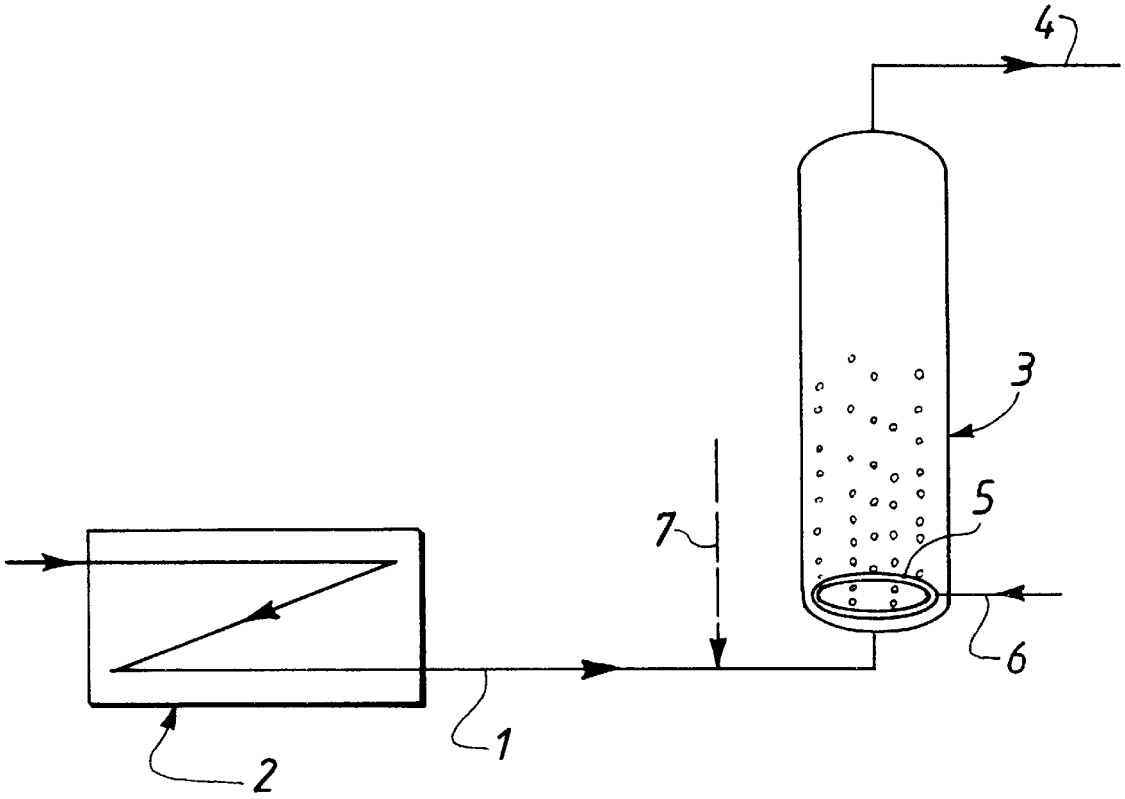
4
3
5
7
6
1
2

PROCESSES FOR VISBREAKING HEAVY HYDROCARBON FEEDSTOCKS

RELATED APPLICATION

This application claims priority to French Application No. 95.14314, filed Dec. 4, 1995, incorporated herein by reference.

FIELD OF THE INVENTION

The present invention relates to improvements made to processes and apparatus for visbreaking heavy hydrocarbon feed-stocks.

BACKGROUND OF THE INVENTION

It is known that by visbreaking is meant a treatment of heavy hydrocarbon feedstocks which comprises placing said feedstocks in the liquid state into a furnace at a temperature sufficient to cause the heaviest hydrocarbons to crack and then introducing them into a maturation device (known in the art as a "soaker") wherein, without additional heating, they travel at a rate such that at the prevailing temperature they have a sufficient residence time for achieving the desired cracking of the heavy molecules into lighter molecules. The cracking results in a reduction in viscosity of the treated feedstock. This process is known as visbreaking (a term of art used as an abbreviation for "viscosity reduction"), and the apparatus used is known as a visbreaker.

The soaker usually has the form of a cylindrical enclosure which is not provided with additional means for heating the feedstock and in which, because cracking is endothermic, the feedstock temperature drops a few tens of degrees between the time the feedstock enters the soaker and the time it exits. The temperature in the soaker is generally about 400–500° C. an the pressure about 2 to $30\times10^5$ pascal. The residence time of the feedstock in the soaker is about 10–30 minutes. The severity, which is a function of the residence time and the soaker temperature, is of the order of 20 minutes.

The feedstock to be treated is injected at the bottom of the soaker, whereas the cracked product, including any gaseous products that may have formed, is discharged at the top and is directed to a fractionation unit for atmospheric distillation followed by vacuum distillation.

The feedstock to be treated can be a heavy petroleum crude, an atmospheric distillation residue, used only rarely because there are other ways of utilizing it, a vacuum distillation residue or a deasphalting pitch.

After fractionation, the visbroken products consist of gaseous hydrocarbons, liquefied petroleum gas, gasoline, gas oil, distillate and visbroken vacuum residue.

The visbroken vacuum residue is the last recoverable product and, to be used as fuel oil base, must meet stringent requirements of stability and compatibility with other petroleum fractions. Hence, to meet these requirements, the operator must adjust the visbreaking conditions, particularly the temperature.

A major problem encountered in visbreaking units lies in the nonuniform travel of the charge stock inside the soaker and in back-mixing and vortexing, occurring particularly in the vicinity of the side walls and at the bottom of the soaker. These disturbances are aggravated by the gases generated by the cracking reactions and by the fact that the residence time of the feedstock in the soaker varies markedly in the same crosssection, depending on the zone considered. As a result, there is a risk that part of the treated feedstock will be overcracked, while another fraction will be insufficiently cracked.

To eliminate this drawback, it has been proposed in EP-A-007 656 to dispose inside the soaker, transversely to the direction of feedstock flow, a plurality of internal structures consisting of perforated plates, the orifices in said plates being circular and/or having the shape of slits, said orifices preferably constituting from 1 to 30% of the plate surface area.

Thus, at the level of the plate orifices which are traversed by the gas bubbles present, each plate causes mixing of the feedstock. The aforecited European Patent Application recommends that from 1 to 20 plates of this type be used in a soaker.

As indicated in EP-A-0 138 247 (and in equivalent U.S. Pat. No. 4,551,233 issued Dec. 5, 1985), when plates of this type are used, however, the stability of the cracked products is insufficient, particularly when large quantities of gaseous compounds are formed and considerable amounts of coke appear, which entails a serious risk of plugging the plate perforations. This results in extended, costly soaker shutdowns to clean the perforated plates and remove the coke present.

Document FR-A-2 528 444 (see equivalent GB-A-2,133,034) proposes a process for thermal cracking of hydrocarbon oils whereby a fluid, such as steam, is introduced tangentially into the lower part of the soaker (see page 6, lines 8 to 17) through nozzles. The purpose of such introduction is to impart rotation to the hydrocarbon feedstock.

Imparting rotation to the feedstock, however, requires very large amounts of steam which implies a limitation of the space available for the feedstock in the soaker and, hence, a reduction in its residence time, which is prejudicial to visbreaking.

OBJECTS OF THE INVENTION

A purpose of the present invention is to eliminate these drawbacks by use of means suitable for ensuring a more uniform residence time of the feedstock in the soaker and better stability of the visbroken residue.

Another purpose of the invention is to limit back-mixing phenomena occurring during treatment of a heavy hydrocarbon feedstock in the soaker of a visbreaking unit.

Still another purpose of the invention is to reduce coke formation in visbreaking processes and apparatus.

SUMMARY OF THE INVENTION

Applicants have, in fact, found that by injecting a gas such as steam or nitrogen into the soaker co-currently, at least in the vicinity of the bottom and the side walls thereof, results at the same time in better feedstock conversion and thus a marked reduction in coke formation, and better stability of the visbreaker vacuum residue.

Hence, the invention has as a preferred embodiment a process for visbreaking a heavy hydrocarbon feedstock in the liquid state, comprising bringing said feedstock to an appropriate temperature so as to cause cracking of at least part of the hydrocarbon present, then introducing said feedstock into the bottom part of a soaker wherein the feedstock travels from bottom to top to be discharged at the top of said soaker and directed to a fractionation unit, and injecting a, preferably inert, gas into the feedstock in the soaker in the vicinity of the side walls of the soaker, at least at the bottom of the soaker. This process is characterized in that the gas is injected upward along the side walls of the soaker and flows from bottom to top along said walls co-currently with the hydrocarbon feedstock.

The gas (steam, nitrogen, hydrogen, refinery gas or other) by traveling from bottom to top in the vicinity of the soaker walls limits the formation of dead zones and back-mixing in the region of the bottom and the side walls, the residence time of the various fine fluid hydrocarbon streams inside the soaker thus tending to become uniform and to approach the average residence time of the feedstock.

Moreover, the gas has a stripping effect on the products of the charge stock which facilitates the separation of the light products (liquefied petroleum gas, gasoline, gas oil etc.) obtained by conversion in the soaker.

To further minimize back-mixing and coke formation, besides the injection performed at the bottom of the soaker in the vicinity of the side walls, other injections can be performed at different levels of the soaker but always in the vicinity of the side walls.

Upward gas injection in the vicinity of the walls of the soaker, according to the invention, requires only a low gas flow rate which, in particular, eliminates the drawbacks encountered when the process of the abovesaid document FR-A-2 528 444 is used.

For a feedstock flow rate from 75 to 200 met. tons/h, the flow rate of the injected gas is advantageously from 0.2 to 3 met. tons/h and preferably from 0.5 to 2 met. tons/h.

Preferably, the gas, superheated and at a pressure above that prevailing in the soaker, is injected annularly at different injection levels, but the gas can also be introduced into the pipe lines which bring the feedstock to be cracked to the soaker, in which case said gas is introduced upstream of said soaker.

Another preferred embodiment of the invention is an apparatus for visbreaking a heavy hydrocarbon feedstock in the liquid state, of the type comprising a means for heating the feedstock to a temperature appropriate for cracking at least part of the hydrocarbons, and a soaker provided at its bottom with at least one feed line for the preheated feedstock and at its top with at least one line through which the treated feedstock is discharged and directed to a unit for fractionating said feedstock, said apparatus being characterized in that it comprises a means for injecting a, preferably inert, gas into the hydrocarbon feedstock to be treated, the injection means being disposed at a location such that inside the soaker the injected gas travels co-currently with the feedstock in the vicinity of the inner face of its side walls, at least at the bottom of the soaker.

The gas injection means can contain regularly spaced injection nozzles connected to a source of compressed gas and disposed annularly either along the bottom part of the inner face of the soaker walls or along the bottom of the soaker.

Said injection means can also contain a conduit of essentially toroidal shape connected to a source of compressed gas and fitted with regularly distributed gas-discharging orifices, said conduit being disposed in the vicinity of the bottom of the soaker and coaxially therewith.

The injection means can also comprise a line for introducing said gas into the heavy hydrocarbon feedstock downstream of the feedstock heating means and upstream of the soaker in the direction of feedstock flow.

Naturally, several identical or different means of injecting the gas into the hydrocarbon feedstock can be provided at different levels of the soaker, in the vicinity of the inner face of the soaker walls.

BRIEF DESCRIPTION OF THE DRAWINGS

In this specification and in the accompanying drawings, we have shown and described preferred embodiments of our invention and have suggested various alternatives and modifications thereof; but it is to be understood that these are not intended to be exhaustive and that many other changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

FIG. 1 is a schematic view of a visbreaking apparatus according to the present invention.

DETAILED DESCRIPTION OF THE PREFERRED EMBODIMENTS OF THE INVENTION

This drawing shows the usual elements of a visbreaking unit, namely line 1 for feeding the heavy hydrocarbon feedstock to be treated in the liquid state;

furnace 2 through which passes line 1 and which preheats the heavy feedstock to an appropriate temperature to ensure the cracking of at least part of the hydrocarbons it contains;

soaker 3, in the form of a closed cylindrical vessel, disposed vertically, which at the bottom is fed through line 1 and which at the top is fitted with line 4 through which the products obtained by cracking the feedstock are discharged and directed to a fractionation unit.

According to the invention, a means for injecting a, preferably inert, gas into the hydrocarbon feedstock is provided inside soaker 3, in the vicinity of the bottom and near its side walls. In the case represented by the drawing, said injection means comprises a conduit 5 of toroidal shape disposed coaxially with the side walls of the soaker at the level of the soaker bottom and which through line 6 is fed with compressed gas. Said conduit 5 comprises regularly spaced orifices through which the compressed gas escapes toward the top of soaker 3, co-currently with the hydrocarbon feedstock. This limits the dead space in the soaker and feedstock back-mixing and prevents coke formation while ensuring stripping of light cracked products present in the soaker.

The use of conduit 5 is advantageous if nozzles such as those described in document FR-A-2 528 444 in reference to FIGS. 3A and 3B are to be used, because such use avoids modifying the reactor and thus complicating its utilization.

As indicated hereinabove, several analogous gas injection means can be provided at different levels of the soaker to optimize the effect of said gas.

Thus, it is possible to use regularly disposed injection nozzles discharging gas, supplied from a source of compressed gas, into the soaker from the direction of the side walls and/or the bottom.

Alternatively, a, preferably inert, gas can be injected under pressure through line 7, represented in the drawing by a broken line, into line 1, downstream of furnace 2 and upstream of soaker 3 in the direction of feedstock flow.

As a preferred embodiment of this latter alternative, with line 7 replacing line 6, line 1 instead would be attached to a peripheral dispersing structure, such as a toroidal conduit (similar to the ring 5, so as to assure upward flow of the gases contained in the feedstock being concentrated along the walls of the soaker 3).

In the case where the gas used is compressed [superheated] steam, it will naturally be necessary to take into account the calories and the water thus introduced into the soaker and to adjust the operating conditions of the soaker accordingly.

Under similar treatment conditions, the process according to the invention makes it possible to obtain a visbreaker vacuum residue of greatly improved stability, as will become clear from the following examples.

It is known, in fact, that the operation of a visbreaker unit is guided by taking the stability of the visbreaker residue as a reference criterion for the use of said residue as fuel, because if the stability is not above a certain threshold, the fuel could, during use, present problems induced by the formation of sediments resulting from the precipitation of asphaltenes.

Under identical severity conditions, the stripping of light cracked products by the injected gas makes it possible to increase the stability of the visbreaker residue. By retaining the same stability value, it is thus possible to increase the degree of feedstock conversion by increasing the soaker temperature.

This is shown be the following comparative examples.

EXAMPLE 1

This example illustrates a conventional cracking process whereby a vacuum distillation residue having the following characteristics is subjected to visbreaking without using an auxiliary gas.

| | |
|---|---|
| Specific gravity | 1.0375 |
| Viscosity ($10^{-6}$ $m^2/s$ at 100° C.) | 3500 |
| Sulfur content (wt %) | 3.86 |
| Conradson carbon residue (wt %) | 19.6 |
| Asphaltene content (wt %) | 12.1 |
| Cut point | 520° C. |

This vacuum residue was heated to a temperature of about 440° C. in the furnace of a visbreaker unit and then introduced into a visbreaking soaker not modified according to the present invention. Said soaker had a diameter of 2.5 meters and an axial height of 14 meters.

The operation was carried out at a temperature of 425° C. and a pressure of $8\times10^5$ pascal. The flow rate of the feedstock was about 100 met. tons/h and its residence time was of the order of 18 minutes.

The visbroken effluent discharged from the soaker was fractionated in an atmospheric distillation column and then in a vacuum distillation column.

The products obtained after fractionation and the quantities thereof are shown in Table 1 (following these examples).

EXAMPLE 2

The same vacuum distillation residue as in Example 1 was once again subjected to visbreaking under identical severity conditions. The feedstock was heated in the furnace to a temperature of about 450° C. and the soaker was operated at a temperature of 430° C. and a pressure of $8\times10^5$ pascal.

The soaker was fitted, according to the invention, with a distributor for pressurized steam consisting of a toroidal conduit having a diameter of 30 millimeters and presenting regularly distributed upward-facing orifices. Said distributor rested on the bottom of the soaker and was disposed coaxially with the side walls. The superheated steam was injected at a pressure of $11\times10^5$ pascal and at a rate of 0.5 met. tons/h, whereas the flow rate of the charge stock was 100 met. tons/h. The residence time of the charge stock was of the order of 15 minutes. In other words, the severity of operating conditions was similar to those of Example 1.

As before, the visbreaker effluent was fractionated first in an atmospheric distillation column and then in a vacuum distillation column. The results obtained are also collected in Table 1 below.

As can be seen, gas production decreased, the production of gasoline and liquefied petroleum gas (LPG) increased slightly, the production of gas oil increased markedly and the quantity of visbreaker vacuum residue (VVR) decreased.

The viscosity of the visbreaker vacuum residue was unchanged, but its stability improved, and sediment formation was reduced.

EXAMPLE 3

The same vacuum distillation residue as in Example 1 was subjected to visbreaking under the same severity conditions as in Examples 1 and 2.

The residue was heated in the furnace to 455° C. and then introduced into the soaker which was equipped with a steam injection ring identical to that of Example 2. The soaker was operated at a temperature of 434° C. The pressure and flow rate conditions of the steam in the soaker were the same as in Example 2.

The flow rate of the charge stock and its residence time in the soaker were the same as in Example 2. The severity conditions were thus more pronounced than in Examples 1 and 2.

As in these examples, the effluent from the soaker was fractionated first in an atmospheric and then in a vacuum distillation column.

The products obtained are shown in the following Table 1. It can be seen that when the quantity of gas was essentially the same as that in Example 2, the quantity of gasoline, liquefied petroleum gas and distillate increased, the quantity of gas oil increased markedly and that of the visbreaker vacuum residue decreased appreciably.

The viscosity of the vacuum residue increased slightly compared to that in Examples 1 and 2, and its stability was identical to that in Example 1 despite more severe visbreaking conditions.

TABLE 1

| Products Obtained After Fractionation, (wt %) | Example 1 | Example 2 | Example 3 |
|---|---|---|---|
| Gas | 0.64 | 0.42 | 0.44 |
| Gasoline + LPG | 5 | 5.3 | 5.5 |
| Gas oil | 12.3 | 13.7 | 14.3 |
| Distillate | 10.9 | 10.3 | 10.8 |
| VVR | 71.2 | 70.2 | 68.9 |
| Stability of VVR | | | |
| - stability* | + | ++ | + |
| - sediments (**), ppm | 850 | 500 | 800 |
| Viscosity of VVR ($10^{-6}$ $m^2/s$ at 100° C.) | 40,000 | 50,000 | 70,000 |

(*) Measured, for example, by ASTM test method D 1661 (ASTM Standards, pages 657–661, vol. 05.01, 1989 edition).
(**) Measured by French test method NFM 07063. The filtration temperature was adapted to the product and was above 100° C. An additional washing with a solvent suitable for the filtration temperature used was carried out before washing with dodecane.

These results thus show clearly the advantage of injecting a gas into the soaker co-currently with the feedstock being treated.

We claim:

1. Process for visbreaking a heavy hydrocarbon feedstock in the liquid state, comprising:

bringing said feedstock to an elevated temperature sufficient to cause cracking of at least part of the hydrocarbons present, introducing said hot feedstock into the lower part of a soaker vessel having upwardly extending side walls, passing the hot feedstock therethrough while being physically contained in direct contact with said walls, discharging the resulting partially cracked products from the upper portion of said vessel, fractionating the discharged products, injecting a gas compatible with the hydrocarbon feedstock into the soaker vessel at least adjacent to the bottom of the vessel so as to flow upwardly primarily along the vessel's side walls through the liquid feedstock and any cracked products directly contained by said walls, whereby the gas flows from bottom to top along said walls co-currently with the hydrocarbon feedstock in a manner and at a rate effective to increase at least one of stability of the resulting visbreaker residue and degree of feedstock conversion and to reduce coke formation by diminishing back-mixing and formation of dead zones in the region of the side walls.

2. Process according to claim 1, wherein the vessel wall which contacts and contains the feedstock and products is impervious.

3. Process according to claim 2, wherein the gas is injected into the soaker vessel at several different levels, all adjacent to the inner face of the side walls.

4. Process according to claim 2, wherein the gas is injected into the soaker vessel from a series of points spaced from one another to form a ring around the base of said walls.

5. Process according to claim 2, wherein said gas is injected into the hot feedstock upstream of the soaker vessel in the direction of feedstock flow, and the introduction of the hot feedstock into the soaker vessel is such that the gas combined therewith is injected upwardly therein so as to flow along the side walls thereof.

6. Process according to claim 2, wherein for a feedstock flow rate in the soaker vessel of from 75 to 200 metric tons/hour, the gas flow rate is from 0.2 to 3 met. tons/h.

7. Process according to claim 2, wherein for a feedstock flow rate in the soaker vessel of from 75 to 200 met. tons/h, the gas flow rate is from 0.5 to 2 met. tons/h.

8. Process according to claim 4, wherein for a feedstock flow rate in the soaker vessel of from 75 to 200 met. tons/h, the gas flow rate is from 0.2 to 3 met. tons/h.

9. Process according to claim 4, wherein for a feedstock flow rate in the soaker vessel of from 75 to 200 met. tons/h, the gas flow rate is from 0.5 to 2 met. tons/h.

10. Process for visbreaking a heavy hydrocarbon feedstock in the liquid state, comprising:

bringing said feedstock to an elevated temperature sufficient to cause cracking of at least part of the hydrocarbons present, introducing said hot feedstock into the lower part of a soaker vessel having upwardly extending side walls, passing the hot feedstock therethrough while being physically contained in direct contact with said walls, discharging the resulting partially cracked products from the upper portion of said vessel, fractionating the discharged products, injecting a gas compatible with the hydrocarbon feedstock into the hot feedstock upstream of the soaker vessel in the direction of feedstock flow, such that the gas flows from bottom to top primarily along said walls co-currently with the hydrocarbon feedstock in a manner and at a rate effective to diminish the formation of any dead zones in the region of the side walls.

11. Process for visbreaking a heavy hydrocarbon feedstock in the liquid state, comprising:

bringing said feedstock to an elevated temperature sufficient to cause cracking of at least part of the hydrocarbons present, introducing said hot feedstock into the lower part of a soaker vessel having upwardly extending side walls, passing the hot feedstock therethrough while being physically contained in direct contact with said walls, discharging the resulting partially cracked products from the upper portion of said vessel, fractionating the discharged products, injecting a gas compatible with the hydrocarbon feedstock into the hot feedstock upstream of the soaker vessel in the direction of feedstock flow, such that the gas flows from bottom to top primarily along said walls through and co-currently with the hydrocarbon feedstock and cracked products contained by direct contact with said walls in a manner and at a rate effective to increase at least one of stability of the resulting visbreaker residue and degree of feedstock conversion and to reduce coke formation by diminishing back-mixing and formation of dead zones in the region of the side walls.

* * * * *